US006513173B1

(12) United States Patent
Sykes

(10) Patent No.: US 6,513,173 B1
(45) Date of Patent: Feb. 4, 2003

(54) ENTERTAINMENT DEVICE AND SYSTEM

(76) Inventor: John Sykes, The Old Vicarage, Scalby Scarborough North Yorkshire (GB)

( * ) Notice: Subject to any disclaimer, the term of this patent is extended or adjusted under 35 U.S.C. 154(b) by 0 days.

(21) Appl. No.: 09/743,496

(22) PCT Filed: Jul. 1, 1999

(86) PCT No.: PCT/GB99/02064

§ 371 (c)(1),
(2), (4) Date: Mar. 6, 2001

(87) PCT Pub. No.: WO00/03099

PCT Pub. Date: Jan. 20, 2000

(30) Foreign Application Priority Data

Jul. 10, 1998 (GB) ..... 9814889
Jul. 24, 1998 (GB) ..... 9816097

(51) Int. Cl.[7] ..... E03D 13/00; A47K 11/12
(52) U.S. Cl. ..... 4/301; 4/661
(58) Field of Search ..... 4/301, 661, 314

(56) References Cited

U.S. PATENT DOCUMENTS 4,773,863 A 9/1988 Douglas, III
5,111,539 A * 5/1992 Hiruta et al. ..... 4/301
5,363,516 A 11/1994 Butts
5,410,471 A * 4/1995 Alyfuku et al. ..... 4/314
5,499,008 A * 3/1996 Rosenkrantz et al. ..... 4/661
5,560,051 A 10/1996 Butts
5,867,848 A 2/1999 Ort
5,945,910 A * 8/1999 Gorra ..... 340/573.1
5,978,975 A * 11/1999 Asskaryar ..... 4/661

FOREIGN PATENT DOCUMENTS

JP 2-285172 * 11/1990 ..... 4/661
JP 4-203129 * 7/1992 ..... 4/301
JP 10267924 10/1998
WO WO 94/02918 2/1994
WO WO 01/18315 * 3/2001

* cited by examiner

*Primary Examiner*—Charles R. Eloshway
(74) *Attorney, Agent, or Firm*—Woodard, Emhardt, Naughton, Moriarty & McNett LLP

(57) ABSTRACT

A facility for use as entertainment and/or education wherein there is provided at least one sensor on or adjacent to a surface of the facility that is in connection with a visual display. The condition of the display changes in response to the activation of the sensor. In one embodiment, the facility is a urinal. An alternate embodiment includes a video or electronic message display mounted in conjunction with the urinal to be viewed that may or may not be activated by a sensor.

11 Claims, 4 Drawing Sheets

ENTERTAINMENT DEVICE AND SYSTEM

The invention which is the subject of this application is a device and system which can be used for any of entertainment, educational and/or practical purposes and can, in one particular, but not exclusive use, allow a facility such as a urinal, which are provided as standard in most commercial premises, to perform a function in addition to that for which it is installed.

At the present time urinals are manufactured from any of sheet metal or ceramic or plastics material, typically of a uniform colour and are installed individually or as a group in public houses, restaurants, football grounds, concert halls and in general in any premises where there may be a demand for their use by a number of persons. Once installed the urinals form part of the fabric of the premises and no further use of the same is made other than for the purpose for which they are installed.

The aim of the present invention is to provide a device and system which allows the utility of urinals and toilet bowls to be improved so that the same can be used, in one embodiment, to commercial advantage and/or to provide entertainment to the person using the same. In other potential uses as herein described the device and system can be used for educational purposes and in one alternative embodiment can be used in the training of children to use the conventional toilet bowls installed in domestic premises.

In a first aspect of the invention there is provided a facility against which a liquid is impacted and said facility includes a system comprising at least one sensor adapted to be activated by the liquid and wherein the sensor is provided as part of a surface of said facility against which the liquid is impacted, and connected to a means in the form of an audible and/or visual display to allow a change in condition of the display upon impact of the liquid on the sensor.

In one embodiment, the display is activated for the duration of impact or, alternatively for a predetermined period of time.

In one embodiment the at least one sensor is mounted on a retaining means, said retaining means passing from the rear of a wall of the urinal to the front surface of the facility and carrying therealong electrical connection means to and from the sensor so that said sensor is exposed on the surface. In a preferred embodiment the surface where the sensor is positioned is provided with a lip portion to prevent contact of flushing liquid onto the sensor. Alternatively the facility is provided with a means for detecting when a person is in the vicinity of the facility and during which time the facility does not flush so as to prevent flushed liquid contacting the sensor. In a further alternative, when the presence of a user of the urinal is detected then the sensor can be on standby for subsequent activation by contact with the liquid and at other times is not operational. In a further alternative, sensors are provided to detect the passage of flushing liquid, typically in the pipe which supplies the flushing liquid to the urinal and, when the liquid is detected the device and system is rendered inoperable for the duration of the supply of the flushing liquid.

The urinal facility can either be in the form of male or female urinals or a toilet bowl.

In one embodiment the sensor which is used reacts to changes in the condition of the temperature of the same. Preferably the face of the sensor is provided with a shim of material to mask the same from direct contact with the liquid and hence reduce the temperature change caused by the liquid upon impact.

In an alternative embodiment the sensor used is a conductive sensor, which utilises two electrodes, a cathode and anode, mounted side by side on the surface preferably in a horizontal plane, which is provided to be activated when liquid impacts on the same and causes the completion of an electrical circuit between the electrodes. In this embodiment it is preferred that the sensor is provided in conjunction with an a.c. detection circuit to prevent electrolysis of the sensor. It is known that when the sensor is used, over time at least one of the electrodes will not operate as efficiently as desired due to electrolysis of the same. The provision of an a.c. detection circuit allows the transferring and switching of the direction of current at intervals of operation so as to prevent any one electrode from being constantly used as the anode or cathode by reversing polarity and so as the operation of each electrode is swapped with the other at frequent intervals. Typically the switch is operated 1,000 times per second, and high quality stainless steel is used for the electrodes to prevent corrosion of the same.

Typically each of the electrodes is provided with a means for securing the same in position on the urinal surface, such as a screw thread, rivet formation etc, and alternative sensors can also be fixed in this way.

In alternative systems a pressure sensor can be utilised in which the pressure sensor is mounted under the surface or alternatively may be covered on the surface by a material which may be printed or otherwise provided to define a larger area and indicate the position of the sensor or sensors. Alternatively a proximity switch 38 or sensor is provided so that when a person is using the facility proximity switch beam is broken and the system is operational and when they stop using the facility, the system returns to a standby condition.

A further feature of these embodiments is that the flushing of water doesn't affect the sensor operation.

Typically the urinal facility will include a plurality of urinal locations or units in the same facility and each of said urinal locations can include at least one sensor, said sensors connected to a common display and/or processing means so as to allow competition between person at different urinal locations, or alternatively, each urinal location has its own display and processing system, and there may also be provided a master control system which controls more than one display.

In use it is envisaged that the sensor can be adapted to provide an indication of one or a combination of aspects relating to the liquid impacting thereon such as any or any combination of the height of impact of the liquid on the facility, the duration of impact, the volume of liquid, the pressure of impact, the velocity at which the liquid hits the same, the constituents of the liquid and so on.

In one embodiment the results from the at least one sensor are indicated via a display screen on the facility and/or elsewhere in the premises in which the facilities are fitted. In one embodiment a spaced array of sensors are provided and the sensor or sensors in the array which are impacted by liquid affects the display generated.

In a further feature of the invention the power supply to allow the function of the display and/or sensor system can be a mains supply in conjunction with a transformer which reduces the voltage. Typically a failsafe power supply breaking facility is provided. Alternatively a battery power system can be provided.

In one embodiment the display means is an electronically generated display screen and the display and/or processing means for using the signal from the at least one sensor to generate the display can be controlled from a remote source via a communications link provided as part of the facility. It is envisaged that the material displayed can be changed as frequently as required and can be adapted to display current marketing promotions and the like as well as instructions on how to use the system of the invention. In another embodiment of the invention the screen can be used to display pictures, the content of which change during the application of liquid to the at least one sensor and in reaction to the signals received from the at least one sensor. Typically, in this embodiment, the person applying the liquid will be aware of targets which they have to meet to cause the change in display.

The facility can be provided as a free facility or alternatively is required to be activated by the input of a coin or coins or other means which can be pre-purchased or may be provided by winning a prize, collecting sufficient tokens and the like.

In one embodiment the facility can include a memory means and processing means for analysing and selectively saving results achieved by users of the facility on an up-dating basis and which can be retrieved for display. For example the results which have a highest, lowest best value can be saved in an order of merit which can be displayed and act as a target for subsequent users.

In one arrangement the at least one sensor is controlled and constructed to react to the contact with urine rather than any other liquid and in a further embodiment the at least one sensor can be arranged to react to a particular constituent in the liquid, such as alcohol, and in this arrangement the system is used to indicate the level of alcohol present and thereby provide, in one example, an indication to the user of their ability to drive.

Although it is envisaged that the invention is of particular attraction when used in conjunction with a urinal an alternative use is to provide the apparatus as a game in which there is provided a surface, which may comprise a substantially vertical wall, a means for collecting and draining liquid, a display and at least one sensor on the apparatus which, when liquid impacts upon the same causes a change in the display. In one embodiment the liquid is impacted by a player of the game via a supply of the liquid and a dispensing means which may be hand held, hand controlled and/or mounted on the body. The aim of the game is to attempt to hit the sensor or a range of sensors with the liquid and cause a change in display, the collection of points or any variation thereon.

In whichever embodiment the results can be indicated electrically via display screens in the room and/or elsewhere in the premises, or mechanically by moving parts, the position of which are determined by the reading from the sensor. There can also be the facility for the comparison of the results with previous readings received and for individuals to identify their results to provide a scoring table. Typically, means such a keypad are provided to allow users to enter an identity into the system against which their score can be entered.

It is possible that a number of sensors may be provided in a spaced array on the surface so as to ensure that the system is more easily activated by contact of liquid with say one of the array of the sensors.

In one embodiment the sensor is mounted in a housing and said housing is inserted in position on the urinal facility, typically lying flush with the surface of the urinal. If, for example, the urinal is made from Glass Reinforced Plastics (GRP) the housing can be provided as an insert embedded in the structure.

In one embodiment the area around the location of the at least one sensor can be indicated by the means of a visual display to indicate the position of the at least one sensor so as to allow the liquid to be aimed at the sensor. In one embodiment the visual display is provided on the housing portion.

In one arrangement the sensor apparatus is provided as a modular system for use in conjunction with male, wall mounted, urinals and the means which reacts is an electronic sensor connected to a processor and visual and/or audible display means to indicate that the urine has contacted the same. The device can also include a means to assess and/or compare specific features of the urine contact on the surface.

In a further aspect of the invention there is provided a urinal having an area for the collection of liquid and a drain for the exit of said liquid and a surface against which the liquid impacts and wherein a display area is provided as a part of the urinal and which display area is activated by the impact of the liquid on at least one sensing means mounted on the surface of the urinal.

In an alternative form of any of the embodiments and aspects described the displays can be activated by a person using the facility and therefore in proximity with the facility rather than the direct impact of liquid on sensors.

In one embodiment the display area is mounted above the surface on which the liquid impacts and is electrically connected to the at least one sensor to allow the change in condition of the display.

In an alternative embodiment the display area is on the surface against which the liquid impacts and includes at least one sensing means in the form of printed material which changes condition upon the impact of liquid thereon. In one embodiment the printed material is advertising material which can be changed by impact of liquid on the display area. The display area can therefore be provided within the facility to be impacted upon by liquid and wherein impact on the same by liquid causes a change in condition. In one embodiment the display area is printed using at least one thermochromic ink so that when liquid is impacted on said ink a change in condition occurs.

In one embodiment ink is applied to form at least part of the target and the ink is of a type which reacts to a change in temperature so that the ink may for example, change colour or may change from being transparent to translucent or vice versa or cause some other visual effect. In one embodiment an area of print which is not normally visible can be made to become visible by the application of liquid such as urine which is relatively warm, onto the same so that the change in temperature causes the change in condition. In one embodiment the flushing of the urinal with cold water allows the change in temperature when is impacted to be greater as flushing with cold water reduces the temperature of the surface. Preferably the ink or other material does not change condition during the flushing with cold water.

In another embodiment the material changes condition on the application of a liquid having certain constituents and this ensures that the condition change only occurs upon contact with certain constituents.

In one embodiment the material is applied directly to the urinal surface by printing or other techniques but another embodiment is for an inlay to be placed in the urinal or on the urinal wall, and said inlay having the material applied thereto. One form of inlay could be a GRP material inlay.

An advantage of this improvement is that the material, once applied, and/or placed in position, produces a visual effect without the need for any further control apparatus or manipulation of the same. This makes the implementation of the device significantly cheaper and easier and due to its simplicity and lack of need for further control equipment, less receptive to damage or vandalism in use.

In an alternative embodiment the device is provided in a form for use with a toilet bowl and in one embodiment the device is provided as an integral part of the bowl with the surface in relation to which the sensor is mounted, an internal wall of the bowl. In an alternative embodiment the device is provided as a unit for attachment to the toilet bowl and includes a surface formed such that when the device is attached to the bowl the said surface lies within the interior area of the bowl and typically toward the rear of the same and the sensor is mounted in relation to the surface or the surface itself may act as a sensor so that, for example, the impact of liquid thereon causes the surface to change colour. It is envisaged that this arrangement is of particular attractiveness for use with young children in training the same to use the toilet bowl and the surface can typically provided with a target area defined by a graphic image of, for example, a cartoon character, to attract the child to use the same. In one embodiment the device can include a power source and the sensor can be adapted to cause a visual display such as light illumination and/or audible display such as a nursery rhyme when the sensor is hit by the child.

It should be appreciated that any mention herein of sensor as singular should be interpreted as also including a number of sensors or sensor components.

In a yet further aspect of the invention there is provided a urinal facility 2, said facility including a drain, collecting area 46 for urine and a surface and wherein said facility includes an electric visual display 8, and said material data for display is received from a remote location 36 via a data communication system 37.

Typically the facility is provided with a means 35 to allow remote downloading of data for display on the screen and/or other data and in this embodiment the facility need not be activated by the sensor but instead display material, which may change in content but is always active so that a person using the facility can view the display which will typically comprise a screen or electronic message device mounted at the appropriate height. The features discussed with respect to the previous aspects of the invention will be equally applicable to this embodiment of the invention with or without sensor activation.

Specific embodiments of the invention will now be described with reference to the accompanying drawings; wherein FIGS. 1A and B illustrate a urinal including the system according to the invention in one embodiment;

Figure 1A:
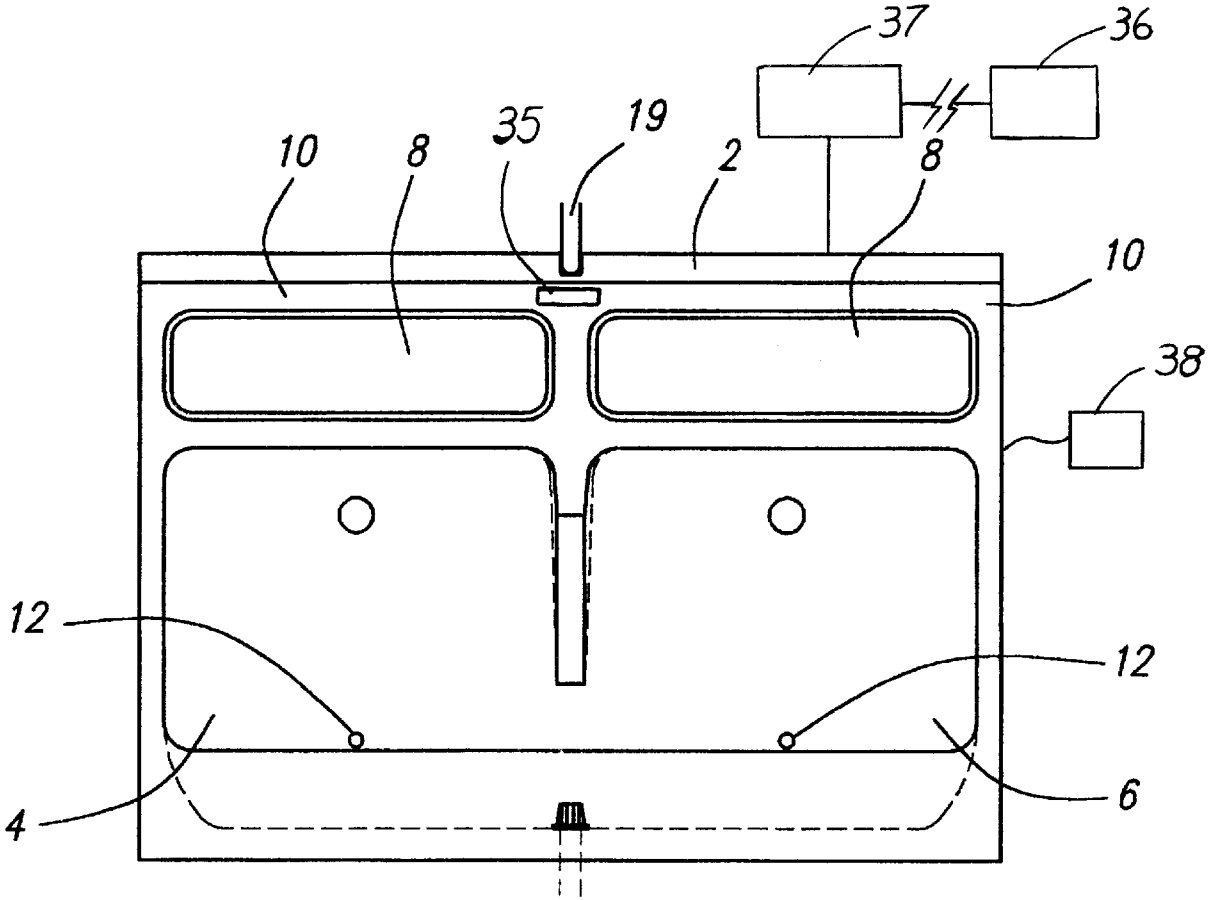
FIG. 1C illustrates in detail part of a sensor of the system in one embodiment.
Figure 1B:
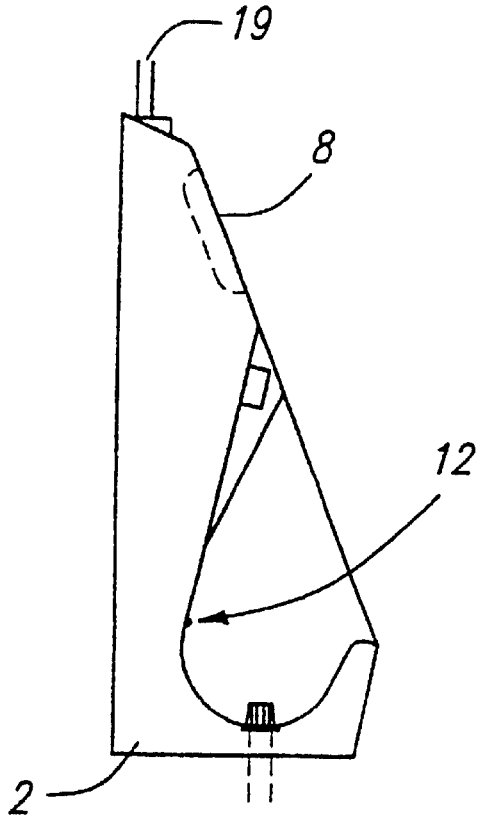
Figure 1C:
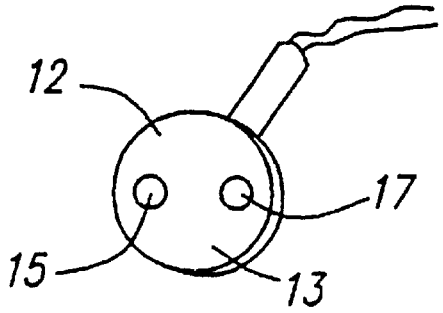
Figure 2:
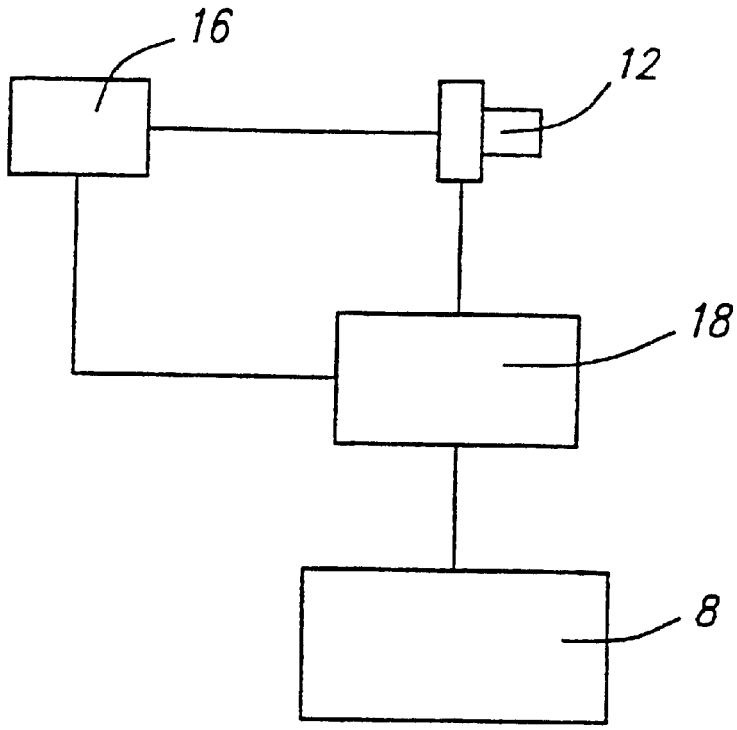
FIG. 2 is a schematic diagram of one embodiment of the invention.

Referring firstly to FIGS. 1A–C there is illustrated a urinal facility 2 in one embodiment, which includes two urinal locations, and is wall mounted with each of the locations 4,6 provided with a modular system according to the invention, which system is shown in schematic detail in FIG. 2. The user of the urinal location sees a visual display screen 8 mounted in the walls 10 of the locations 4,6. The visual display screen can in one embodiment be permanently activated so that the user can view the displayed material or can be selectively activated, for example when the presence of a person is detected in the vicinity by an infra red sensor. The display can also, in standby mode, show to the user, instructions on the operation of the system and the measurements which will be taken and how to achieve a highest score etc. The screen can also be used to show advertising material and/or alternatively can be operated to show displays which change in reaction to the system condition. In the embodiment shown, mounted around the display or in another area of the wall and which can be indicated by a further visual display, there is provided at least one sensor 12 provided to react to the contact of a liquid, in this embodiment, urine, thereon. In addition to a visual display speakers can be provided to allow for audio displays to be provided in conjunction with the visual display. The system and display condition is changed by the contact of the liquid on the sensor which in the embodiment shown in FIG. 1C which illustrates a conductive sensor, causes the electrical circuit to which it is connected, to be completed between the electrodes and a signal generated which can be processed to change the condition of the display, possibly for the duration of contact and which display may change in response to, for example the time of contact, the particular location of the sensor or sensors contacted and so on. The user may also cause the screen display to change by altering the area of contact of the urine, for example, and the sensed change causes a change in the display to be generated.

The best scores achieved may be determined and if sufficiently high, added to a leaders display.

Figure 3:
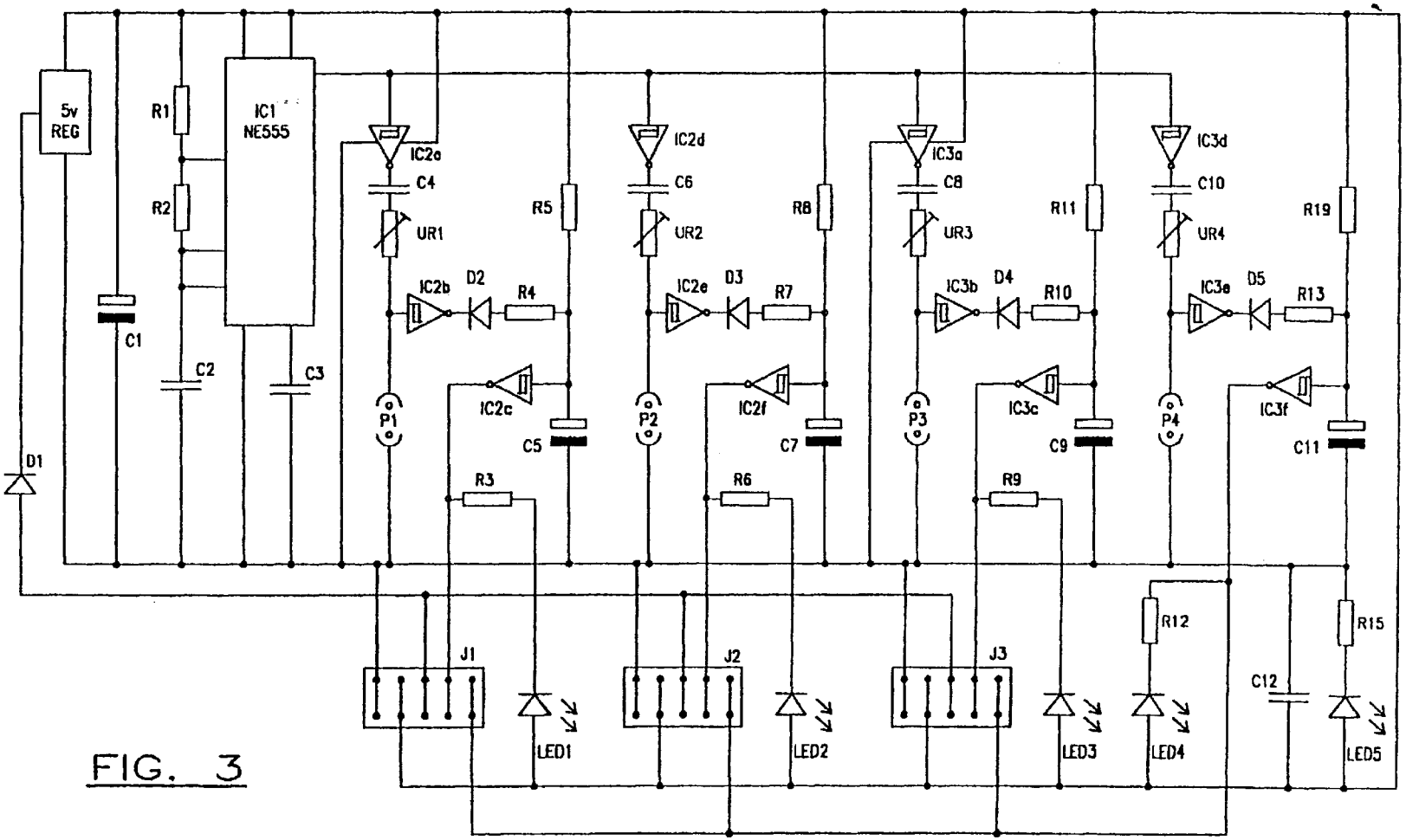
FIG. 3 illustrates a circuit diagram for use with a sensor or sensors in one embodiment.

FIG. 2 illustrates in schematic fashion one circuit arrangement of the system wherein there is provided an activation means 16 which can be any of a receiver for money, free or pre-paid tokens or cards, or automatic activation means such as voice activation or infrared detectors. The activation of the system causes the processor 18 and sensor array 12 to become active. The sensors are exposed to contact with urine and the signal received from the sensors are processed by the processor 18 and a change in the display 8 generated. It is envisaged that if the sensors 12 are of the conductive type 13 illustrated in FIG. 1C comprising two electrodes 15,17 side by side a few millimetres apart, the sensors can be provided in conjunction with an a.c. detection circuit so as to minimise the electrolysis of the electrodes of the sensor in use and hence reduce inefficient operation of the same. The ac detection circuit acts to swap, at intervals, the sensor electrodes between positive and negative conditions. A diagram of one circuit is enclosed as FIG. 3 and this shows one type of a.c circuit in which the pins of J1–J3 are connected to the sensors and the flush sensing system so that signals from the sensors are processed to cause a change or activation of the display, and signals received from the flush sensors mounted in the pipe which supplied flushing liquid 19 in FIG. 1A are used to disable the system while the flushing of liquid takes place. In addition ac probes are provided to allow the transferring and switching of the direction of current at intervals of operation between electrodes so as to prevent any one electrode from being constantly used as the anode or cathode by reversing polarity and so the operation of each electrode is swapped with the other at frequent intervals. Typically the switching occurs 1,000 times per second, and high quality stainless steel is used for the electrodes to prevent corrosion of the same.

It should also be appreciated that the display on the urinal itself need not be a screen but may simply be a target or other fixed display and/or mechanical sensor arrangement so that a display screen need not be provided or, if provided, is mounted separately within the room. It should further appreciated that the facility need not be a urinal and if one refers to FIGS. 1A–C the facility can operate in that form or another form as a game in which the purpose is to aim a liquid fired from, for example a nozzle onto the sensors 12 to score points, win prizes and so on.

Figure 4:
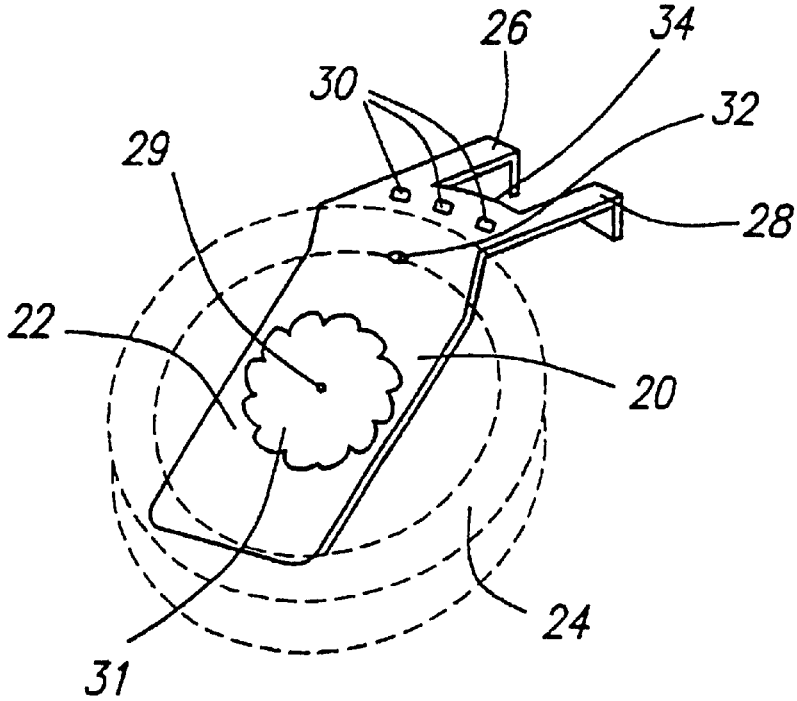
FIG. 4 illustrates a device according to a further aspect of the invention.

FIG. 4 illustrates a further embodiment of the invention and illustrates a device 20 which comprises a surface 22 which can be mounted in a toilet bowl 24 shown in broken line via location hooks 26,28. The surface is provided to lie within the bowl and at the rear thereof and is provided with a sensor 29 which is mounted in relation to a visual display 31. As the device shown is for use in training young children to use the toilet bowl properly the display acts as a target to be aimed at and when the sensor is hit lights 30 and an audio means 32 are activated and powered by power source 34 so as to provide a reward to the child.

In one embodiment the facility includes a series of display screens, and a memory facility 35 onto which material for display can be downloaded. Each screen can be activated by activation of the sensors. When activated the screen can show DVD, CD, Video material. The material can be downloaded on site or from a remote location. In an alternative embodiment the facility can be used as a game of chance wherein a user pays for or is given a token, ticket or other activation means which the user can insert, or can insert coins, into the facility to activate the same and the sensor or sensors. The display is activated and the display may change in a manner so that the user tries to stop or otherwise change the display to win a prize of varying size, or the system may change in a random manner to provide a random result to the user so adding a gambling aspect to the facility.

Thus it will be appreciated that the invention in the various aspect and embodiments herein described is of advantage in generating entertainment, educational and practical benefits to facilities where this was not previously possible.

What is claimed is:

1. A urinal facility, said facility including a drain, collecting area for urine and a surface, said facility including an electric visual display for the display of material data, characterised in that said material data is received and downloaded from a location which is remote from the urinal facility, via a data communication system, said electric visual display comprising a screen mounted on the facility to display the material data to a user of the facility and the facility includes a memory facility onto which the material data for display is downloaded and stored for subsequent display to the user of the facility.

2. A urinal facility according to claim 1 wherein the urinal includes a sensor to activate the display so as to display the material data, said sensor detecting the presence of a person at the said facility.

3. A urinal facility according to claim 2 wherein the sensor is a proximity switch which serves to sense the presence of a person at the urinal facility.

4. A urinal facility according to claim 2 wherein the sensor is a conductive sensor operated by the impact of urine on the same and used in conjunction with an a.c. detection circuit to prevent electrolysis by switching the anode and cathode conditions of the electrodes of the sensor at intervals of operation.

5. A urinal facility according to claim 1 wherein the urinal facility includes a surface on which liquid is impacted, said facility including a system including a sensor adapted to be activated by the liquid impact and wherein the sensor is provided as part of a surface of said facility and connected to selectively activate the electric visual display and/or audio means to allow a change in condition of the same.

6. A urinal facility according to claim 5 wherein the sensor is mounted under the surface to react to pressure and which, upon detecting a change in pressure, causes a change in condition of the electric visual display.

7. A urinal facility according to claim 1 wherein the facility is a wall mounted urinal.

8. A urinal facility according to claim 1 wherein the facility comprises a plurality of urinal locations, each of said urinal locations including at least one sensor, said sensors connected to a common electric visual display or an electric visual display for each urinal location.

9. A urinal facility according to claim 1 wherein the urinal facility includes a coin or token device for operation of the facility.

10. A urinal facility according to claim 1 wherein the facility includes a memory means and processing means for analyzing and selectively saving results achieved by previous users of the facility on an up-dating basis and which can be retrieved for display.

11. A urinal facility according to claim 1 wherein the electric visual display is mounted above the surface on which the urine impacts and is electrically connected to a sensor to allow a change in condition of the display.

* * * * *